United States Patent [19]

Klee

[11] Patent Number: 4,527,844

[45] Date of Patent: Jul. 9, 1985

[54] THERMALLY INSULATED CHAMBER

[75] Inventor: David J. Klee, Emmaus, Pa.

[73] Assignee: Air Products and Chemicals, Inc., Allentown, Pa.

[21] Appl. No.: 461,090

[22] Filed: Jan. 26, 1983

[51] Int. Cl.[3] ..... F25O 11/00

[52] U.S. Cl. ..... 312/214; 312/257 SK; 312/292

[58] Field of Search ..... 52/404, 407, 424, 772, 52/506, 395, 459, 460, 805; 312/292, 214, 257 SK, 138; 220/435, 436, 84, 467; 49/67, 334, 340, 501, 464

[56] References Cited

U.S. PATENT DOCUMENTS

| | | | |
|---|---|---|---|
| 1,681,333 | 8/1928 | Gehnrich | 52/809 X |
| 1,855,802 | 4/1982 | Kemper | 220/435 |
| 2,009,056 | 3/1935 | Schaffert | 52/809 |
| 2,272,067 | 2/1942 | Poivrel et al. | 220/255 |
| 2,996,846 | 8/1961 | Leliaert | 51/13 |
| 3,110,983 | 11/1963 | Moore | 51/9 |
| 3,269,061 | 8/1966 | Massina | 49/340 X |
| 3,334,464 | 8/1967 | Charles | 49/501 |
| 3,824,739 | 7/1974 | Moret et al. | 51/9 |
| 3,981,102 | 9/1976 | Harwood | 49/501 |

FOREIGN PATENT DOCUMENTS

| | | | |
|---|---|---|---|
| 1112048 | 11/1981 | Canada | 51/1 |
| 1103948 | 4/1961 | Fed. Rep. of Germany | 312/214 |

*Primary Examiner*—Victor N. Sakran
*Assistant Examiner*—Joseph Falk
*Attorney, Agent, or Firm*—James C. Simmons; E. Eugene Innis

[57] ABSTRACT

Novel construction is disclosed for a thermally insulated chamber for batch treatment of materials therein at low temperature wherein frequent opening and closing of the outer door of the chamber is practiced. The chamber walls as well as the insulated outer door of the chamber are constructed of rigid but relatively light metallic frames which remain at near ambient temperature. These frames are covered by sheet metal linings on their outer faces and by a plurality of abutting sheet metal inner liners spaced from the outer liners, the space therebetween being filled with insulating material. Buckling and warping of the walls and door as a result of shrinkage is avoided by limiting the maximum linear dimension of each inner liner, by provision of flexible expansion joints in the inner surface and flexible support members which attach the linings to the basic framework, so arranged that paths of only low thermal conductance occur.

The designed chambers are especially useful for removal of coatings on material at cryogenic temperature by contacting the chilled material with a high velocity stream of impact medium. An inner door is provided to close the doorway when the outer door is opened.

11 Claims, 12 Drawing Figures

FIG. 3
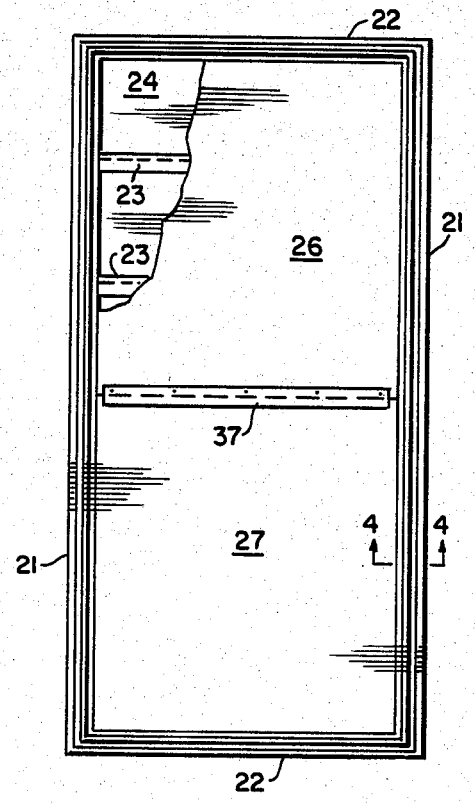
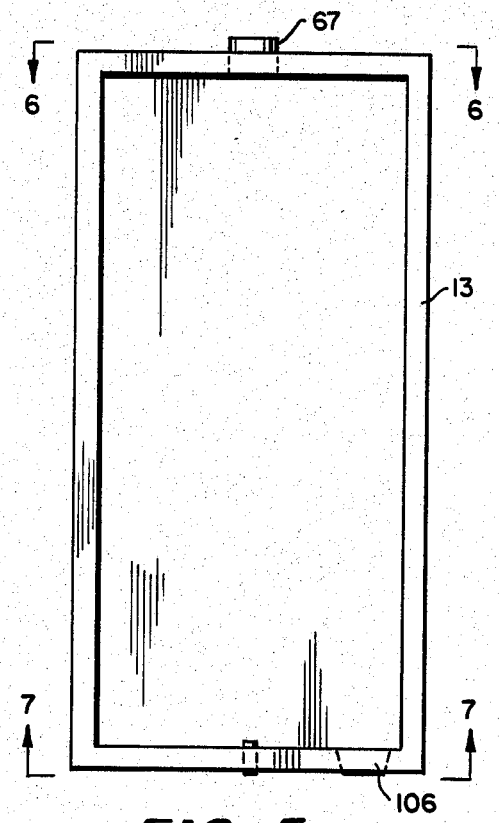
FIG. 5
FIG. 4
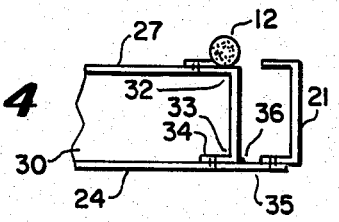
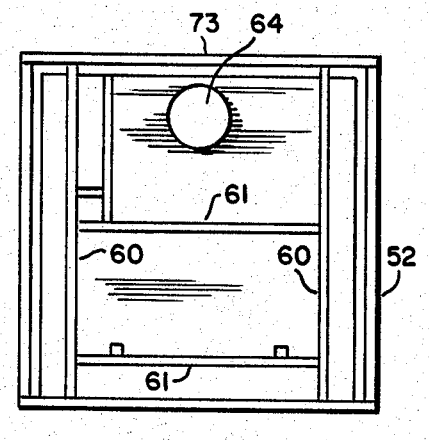
FIG. 6
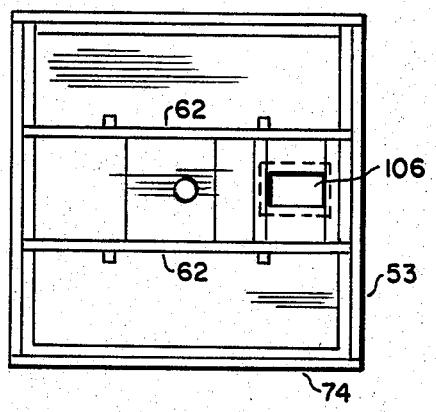
FIG. 7

THERMALLY INSULATED CHAMBER

CROSS-REFERENCE TO RELATED APPLICATIONS

The present application is related to application Ser. No. 445,778, filed Nov. 30, 1982; application Ser. No. 445,603, filed Nov. 3, 1982; application Ser. No. 445,603, filed Jan. 26, 1983; and application Ser. No. 461,087, filed of even date herewith.

TECHNICAL FIELD OF THE INVENTION

The present invention relates to the batch treatment of materials at low temperature and is particularly concerned with the construction of an insulated chamber for carrying out such treatment, and the insulated access door to such chamber.

BACKGROUND OF THE INVENTION

Various systems are known in the art wherein materials are subjected to treatment within an insulated enclosure at temperatures substantially below those prevailing externally of the enclosure. Among such systems, for example, are included refrigerators and freezers for foods and other perishables as well as insulated chambers wherein articles are chilled to effect embrittlement of associated flash or coatings to facilitate removal of the embrittled portions by high velocity impact with particles of blasting media. To reduce heat leaks from such enclosure and heat transfer through the walls of the enclosure, the walls are thermally insulated and suitable gaskets and other sealing means provided at appropriate places. In installations wherein the temperature differential maintained within the enclosure and the external environment is relatively large, such as a $\Delta T$ in the order of 200°-300° F. (=93°-149° C.) or more, there are construction problems associated with the expansion and contraction of structural elements leading, among other untoward effects, to warpage of the chamber walls and the access door thereto. These problems are particularly pressing in relatively large installations, because of the increased dimensional extent of thermal contraction and expansion at a given temperature ranges, and even more so in systems operated in the batch mode wherein the cold chamber is subjected to frequent opening and closing of the access door. This is the case, for example, with systems wherein workpieces, such as coated articles are subjected to cryogenic temperatures within an insulated chamber in a batch operation for embrittlement of the coating to facilitate removal of the coating. Such coating removal will entail a relatively short cycle time of generally less than ten minutes, involving frequent opening of the door between batches while the system is operating at a temperature in the order of about −200° F. (−129° C.). In commercial installations of large size, accordingly, the problems of structural stability despite frequent exposure to changing temperature, are correspondingly aggravated.

Also, in insulated chambers used for low temperature processes, the chamber insulation system needs to be sealed to preclude moisture condensation within the insulation, since such condensation will damage the insulation and render the same ineffective. Commonly, such low temperature insulation systems are protected from moisture condensation therein by lining the interior and exterior surfaces with a metallic material. Such inner metallic liner, of course, will exhibit thermal contraction and expansion as the system cycles from room temperature to cryogenic temperature. Accordingly, the amount of the thermal contraction usually limits this construction technique to relatively small sections, for example less than 60 inches (=152 cm.) in the longest dimension.

It should also be noted in the described prior insulation systems employing outer and inner metallic liners, the outer liner is usually reinforced to provide mechanical strength and stability to the insulated chamber assembly. The inner liner contracts and expands with changes in temperature to which it is alternately exposed, with some buckling and warping thereby resulting. The maximum length of the inner liner and the lowest operating temperature to which it is exposed, determine the total shrinkage of such liner. For example, in a freezer employing liquid nitrogen, wherein the inner liner of the cabinet wall is about 46 inches (=117 cm.) and is exposed to a temperature of about −280° F. (−173° C.), it has been found that there is a shrinkage of about 0.121 inches (0.31 cm.). The extent of buckling and warping of the inner liner under these conditions can be tolerated.

In a freezer employing $CO_2$, on the other hand, where the lowest temperature of the operating range is about −90° F. (=−68° C.), an inner liner having a length of 98 inches (=249 cm.) will shrink a maximum of about 0.134 inches (=0.34 cm.), which extent of shrinkage would not effect buckling and warping of the inner liner beyond tolerable limits. However, when the combination of maximum length of the inner liner and the low operating temperature to which the liner is exposed, causes a total shrinkage in excess of the indicated limits, the inner liner will buckle and warp to an extreme degree, causing failure of the inner liner as well as the outer liner. Accordingly, in previous structures having metal panels subjected to extreme changes in temperature, construction was limited in size and temperature variation range to dimensions that will experience a total thermal change in length of no more than about 0.121 to 0.134 inches (=0.31 to 0.34 cm.).

As in the case of the stationary walls the insulated doors of cold chambers are also constructed with metallic outer and inner liners to protect the insulation therebetween from moisture condensation effects. When the metallic edge of the insulated door has a temperature variation from the "cold" face to the "warm" face, the edge of the door will bow. As the amount of the temperature difference increases the extent of distortion, the door will no longer effectively seal, and a gas leak then ensues. The magnitude of the distortion is also proportional to the size of the door; i.e. the length of the door edge. In large conventional insulated doors it is known to incorporate a massive frame external to the insulated door, to resist warpage of the door. Such external frames, besides being very heavy and costly, have only a limited value in controlling warpage of the door.

For efficient operation of systems of the type described, it will be appreciated that it is necessary to maintain a tight seal when the door to the chamber is closed, to prevent influx of warmer air and loss of cold cryogenic gas. To assure the required effective sealing the insulated doors must remain dimensionally stable and withstand the variation in temperatures to which the outer and inner faces of the door are exposed while the door is in its closed position, as well as the immediate change in temperature to which the inner face of the door is exposed between the frequent opening and closing of the door. Any warping or buckling beyond acceptable limits of the door itself and/or of the doorway of the chamber within which the door fits in closed position, will result in poor sealing of the chamber and entail additional expense in the cost of the cryogenic gas needed to maintain desired low temperature operation therein.

Among the several objects of the present invention is to provide a thermally insulated chamber with an insulated access door of novel construction, overcoming the problems heretofore encountered in or presented by prior art structures. A further object is to provide an improved construction adapted for use in large cryogenic chambers having insulated doors, which can be operated efficiently and effectively over a long period of useful life, without suffering excessive warping and deformation at low operating temperatures. A further object is to provide an improved thermally insulated chamber wherein effective hermetic sealing is maintained during operations therein and wherein the insulation within the walls and the door of the chamber is protected against moisture condensation therein.

The foregoing objectives are achieved by the novel construction and arrangement of the present invention.

While not limited thereto, the novel construction of the present invention has its most beneficial advantages in connection with systems employed in removal of flash and coatings by embrittlement and impact. In such systems the workpieces to be decoated, for example, are placed in a thermally insulated chamber wherein they are subjected to a low temperature gaseous atmosphere to effect the desired embrittlement and therein contacted with a high velocity stream of an impact medium such as plastic particles. The cryogenic chamber employed for such decoating operations requires a rigid frame to provide structural integrity for supporting the various mechanical systems in addition to the weight of the chamber itself, which systems include one or more throwing wheels for centrifugally hurling the impact media at high velocity against the workpiece, a plurality of conveyor systems for circulation of the impact media, and mechanically operated means for opening and closing the relatively heavy access door to the treating chamber. The structural framework of the chamber, accordingly, must be sufficiently rigid to maintain the position and alignment of the associated mechanical systems without excessive deflection or vibration.

Decoating operations in particular can be carried out in these cryogenic chambers relatively rapidly, such that in a batch operation the cycle time from one batch to the next needs to be no more than about six to eight minutes. Thus, the outer door to the chamber needs to be opened and closed frequently while the system is at operating temperature, in the order of about −200° F. (= −129° C.).

Examples of various prior art systems for cryogenic deflashing and decoating are described in U.S. Pat. Nos. 2,996,846; 3,110,983; 3,824,739; and Canadian Pat. No. 1,112,048; as well as in the copending U.S. patent applications hereinabove listed.

SUMMARY OF THE INVENTION

In accordance with the invention there is provided a rigid but relatively light skeletal framework for the stationary walls of the insulated chamber, which framework remains at near the ambient temperature prevailing outside the chamber. The outer access door of the chamber comprises a rectangular frame into which a preformed insulated panel is fitted. The door panel comprises an outer rectangular sheet metal liner and several separate adjoined inner sheet metal liners affixed to the outer liner. Each such inner liner is in the form of a rectangular pan having a flat face and a peripheral wall formed by bending up the edges of the liner and then bending each of such bent up opposed edges inwardly towards one another to provide a narrow peripheral lip. The lip so formed provides a flange by which each of the several inner liners is fixedly attached to the outer liner inwardly of the periphery of the outer liner, thus leaving a free peripheral band bordering the assembled door panel. The space between the outer liner and the inner liners of the door panel is filled with suitable insulation material. The assembled insulated door panel is fixedly attached to the rectangular frame of the door by rivets or the like passed through the peripheral band bordering the assembled door panel. The size of each inner liner is limited such that the liner exposed to the lowest temperature prevailing on the inside of the chamber, will shrink to no more than the extent to which buckling can be tolerated without untoward effect on maintaining structure integrity and good sealing of the closed door.

The sidewalls and backwall of the chamber are similarly constructed by provision of a structural skeleton framework and panels attached to the framework of each of said walls. Each of the panels is provided with an inner liner and an outer liner between which liners insulating material is arranged.

While the inner liners of the panel forming the access door as well as those forming the walls of the insulated chamber undergo the full extent of contraction determined by the largest dimension of such liner, this shrinkage is accommodated by the provision of flexible expansion joints in the inner surface and flexible support members through which the linings are attached to the basic framework. The supports and attachments of the inner component are so designed that only paths of low thermal conductance are had.

To minimize the entry of warmer ambient air when the outer door is in open position, a dimensionally stable inner door is provided, in accordance with the preferred embodiment of the invention, which inner door is arranged to swing into position to close off the access space and thus seal the chamber inlet during the period that the outer door is open.

The particular details of the various elements and features of construction in accordance with the invention will be understood and their advantages will be evident from the detailed description below, read in connection with the accompanying drawings.

BRIEF DESCRIPTION OF THE DRAWINGS

FIG. 3 is a view of the chamber door in elevation looking at the inner face thereof, with a portion being broken away to show part of the framework and the outer panel of the door;

FIG. 4 is an enlarged partial view showing details of the attachment between the inner and outer linings of the door and the attachment of the assembled panel to the structural framework;

FIG. 5 is a front elevation of the chamber facing the doorway frame, the door being detached therefrom;

FIG. 6 is a top plan view of the chamber with the outer liner removed, taken from the outside thereof and along line 6—6 of FIG. 5;

FIG. 7 is a bottom plan view of the chamber with the outer liner removed, taken along the line 7—7 of FIG. 5;

DETAILED DESCRIPTION

Figure 1:
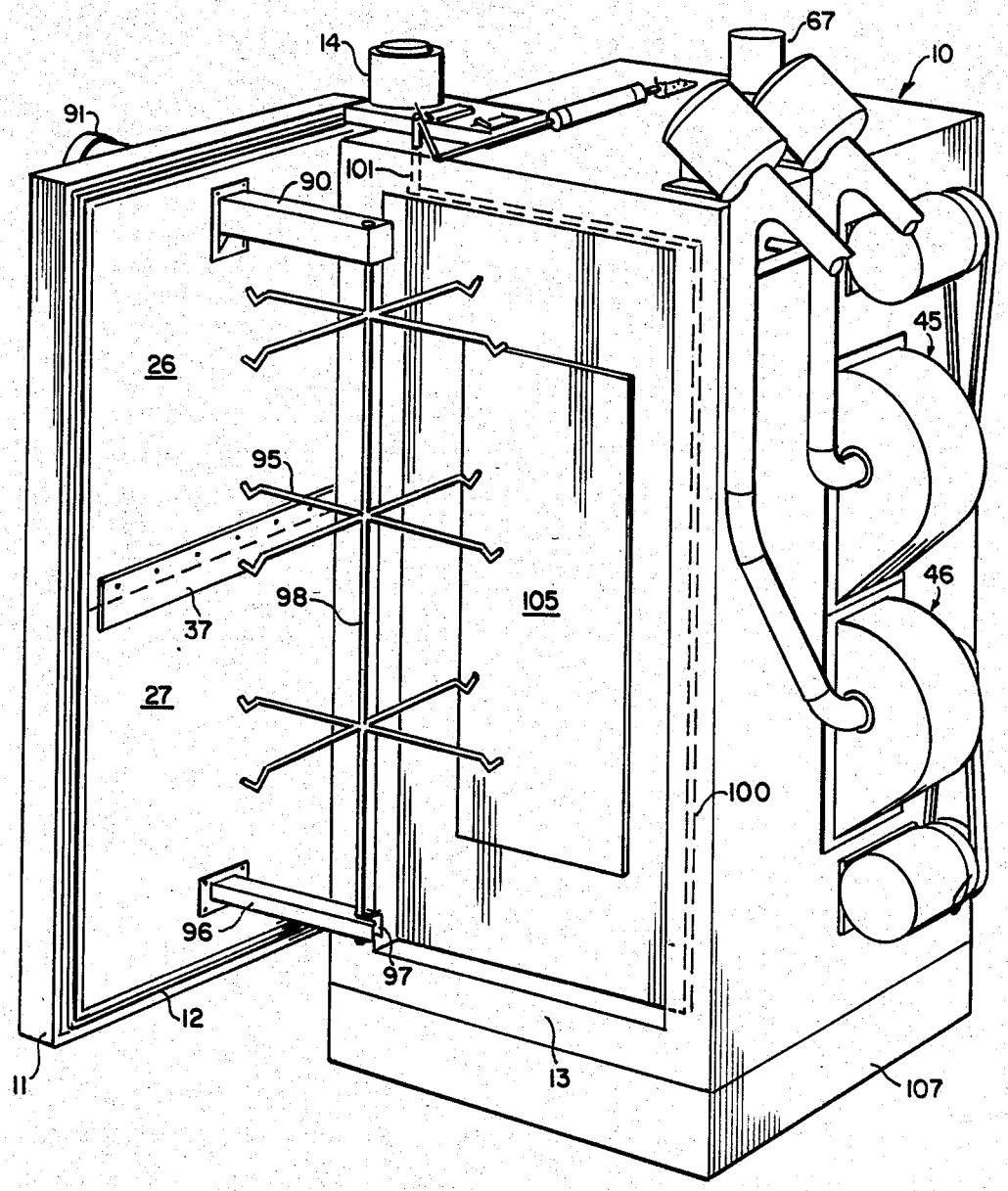
FIG. 1 is a perspective view of an insulated chamber with the outer door in open position and the inner door shown in phantom.
Figure 2:
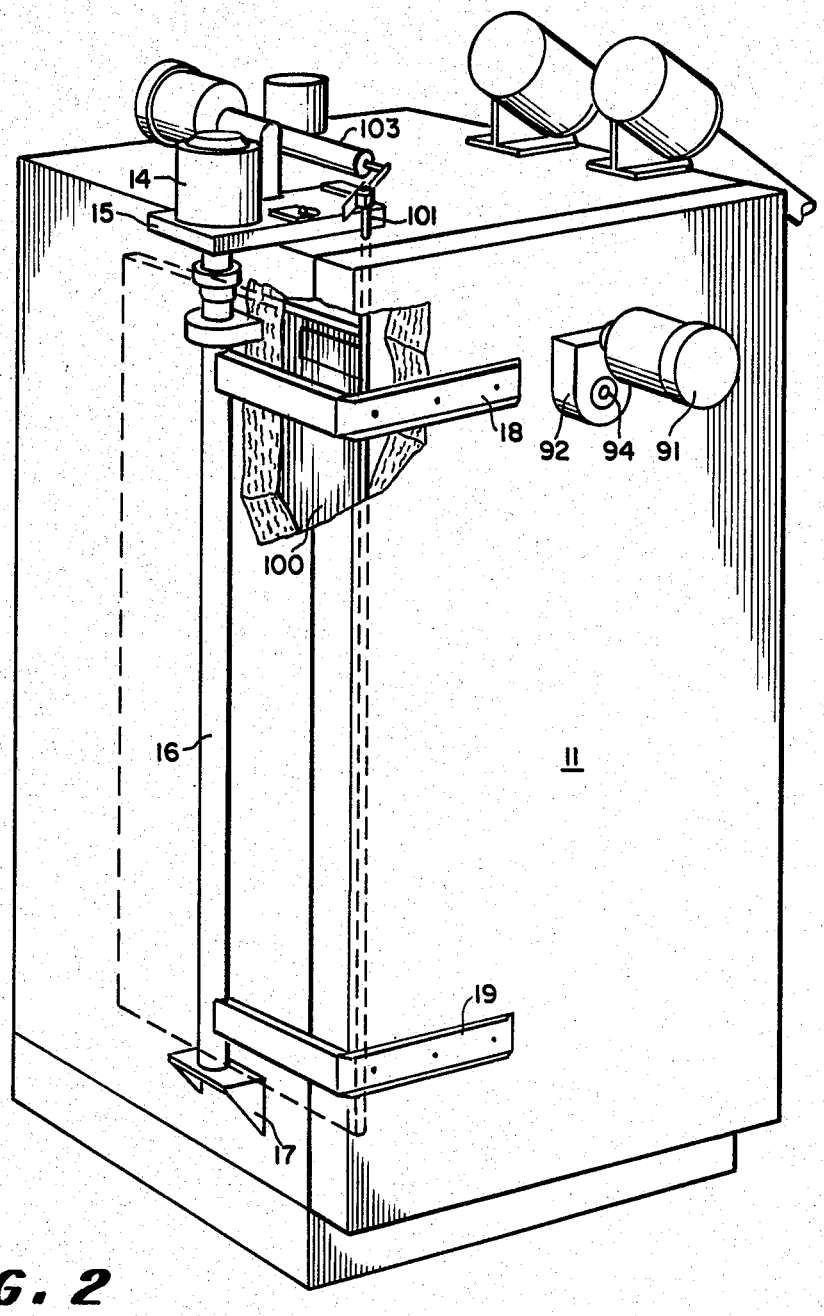
FIG. 2 is a perspective view of the same chamber as in FIG. 1, taken from another angle, and with the outer door in closed portions; positions being broken away to show internal structure.

The particular embodiment illustrated in the accompanying drawings is one especially designed for decoating of work pieces in batch processes within a chamber maintained at cryogenic temperature, wherein frequent opening and closing of the access door occurs. As seen in FIGS. 1 and 2 the chamber 10 is provided with an outwardly swinging access door 11. Flexible sealing means, such as gasket 12, are provided on the inner face of door 11 approximate to its periphery, designed to fit tightly against the jamb and lintel of frame 13 when the door is in closed position.

Mechanical drive means 14 are supported on a shelf or ledge 15 affixed to the roof of the chamber, for rotating the shaft 16. The upper end of shaft 16 is operatively connected to drive means 14 and the lower end of the shaft is journaled in and supported by a bearing bracket 17 affixed adjacent the bottom of a side wall of the chamber, in line with shelf 15. Hinges 18 and 19 respectively are attached to the outer face of door 11, the free ends of which are affixed to shaft 16, whereby the door can be mechanically opened and closed through rotation of shaft 16 under control of the operator.

The framework of door 11 is made of vertical and horizontal steel channel beams, 21 and 22 respectively, rigidly interconnected at their ends to form a rectangular "picture" frame structure as shown in FIG. 3. Horizontal joists or cross members 23 are fixedly attached at their ends to the upper inner liner 26 and lower inner liner 27 at several levels, to reinforce and stabilize the access door. A sheet metal liner 24 which constitutes the outer face of door 11, is rigidly affixed at its peripheral edges to the channel members 21 and 22 of the frame in the manner indicated in FIG. 4.

Upper and lower inner liners 26 and 27 are each attached to the outer liner 24 to provide an inner space 30 between the outer and inner sheet metal liners for insertion of thermal insulation material in the space provided. Thus, as seen in FIG. 4, liner 27 (as well as liner 26) is doubly bent at right angles 32, 33, at its outer edges in the form of a rectangular C, the short horizontal arm 34 of which faces inwardly, parallel to the width of sheet 27. Stated otherwise, each of the inner liners 26 and 27 is formed into the shape of a rectangular pan having a flat bottom and peripheral side walls, each of said peripheral walls being bent inwardly at its free end to provide a lip or flange 34, by means of which the inner liner can be attached to the outer liner by rivets or the like. The several inner liner pans thus formed are attached to the outer liner 24 inwardly of the periphery of liner 24, thus leaving an outward extending band or border 35 by which the assembled panel is fixedly attached, by rivets or the like, to the channel steel framework such as at 21 and 22. To prevent access of moisture through any of the joints formed at the abutment of flange 34 with the face of liner 24, these joints are sealed by caulking with a bead of RTV silicone rubber or other suitable flexible cement as indicated at 36. A metal plate 37 is attached at the boundary of consecutive inner liners. Thus, as seen in FIGS. 1 and 3, plate 37 is attached to liner 26 along the bottom edge thereof and overlaps the seam at the abutting edges. The lower portion of plate 37 is left free and is adapted to slide vertically over the exposed face of lower liner 27 along the upper edge of that liner; to compensate shrinkage of the panel liners. Space 30 is filled with suitable insulation material; preferably about half the space is occupied by rigid urethane foam adjacent the inner panel 26 and 27, and by fiber glass compressed to fill the remaining space to the outer panel 24.

Figure 8:
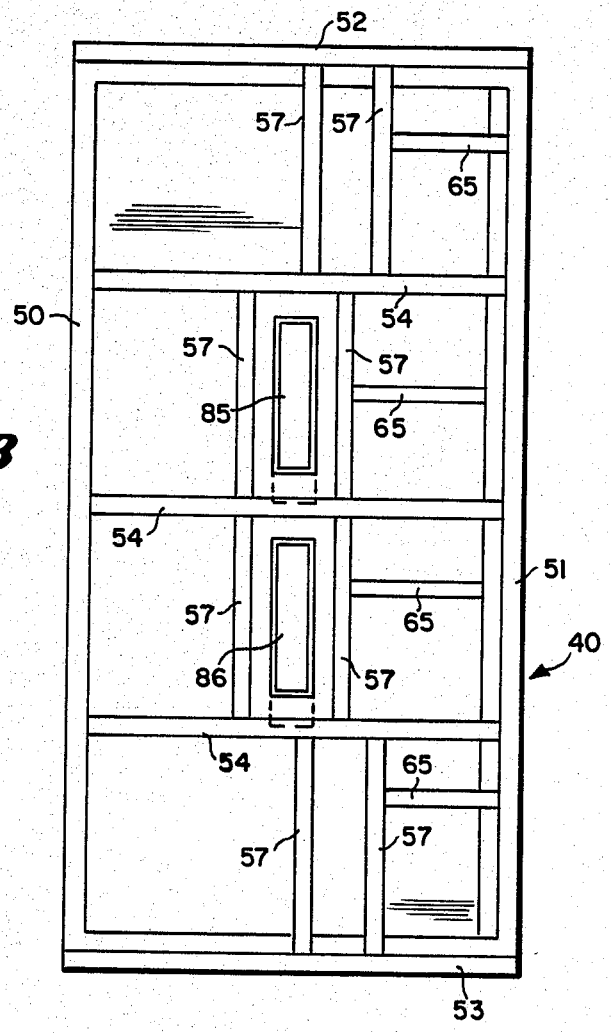
FIG. 8 is an elevational view of a side wall of the chamber with the outer liner removed taken at the inside thereof.

The rigid framework of the chamber proper is provided by thick metal angle bars welded to one another at their ends to form the structural skeletons of the rectangular side walls, back wall and the front doorway frame of the chamber 10. Additional rigidity, except in the case of the doorway frame 13, is achieved by the provision of additional vertical and horizontal angle members at various locations of the walls. Thus, as seen in FIG. 8, the side wall 40 is formed of vertical beams 50 and 51 and upper and lower horizontal beams 52 and 53. Each of the rectangular frames of opposite side wall 41, back wall 42 as well as doorway frame 13 comprise the same basic rectangular frame structure formed of joined angle steel beams; the pattern of reinforcing beams and interconnecting reinforcing struts of the several walls may vary as required.

Referring again to FIG. 8, side wall 40, on which the two throwing wheels 45 and 46 are to be mounted, includes further reinforcement members to assure structural rigidity. The details of the throwing wheels are described in the related application, Ser. No. 445,778, which description is incorporated herein by reference.

These reinforcement members are provided by horizontal angle bar cross pieces, such as 54, at several spaced intermediate levels along the length of the uprights 50 and 51, vertical struts between the horizontal beams and cross pieces as shown at 57; and additional short cross pieces at selected locations, as shown at 65. The particular arrangement of the reinforcing structure is designed to accommodate particular stress factors associated with each of the individual walls.

Figure 10:
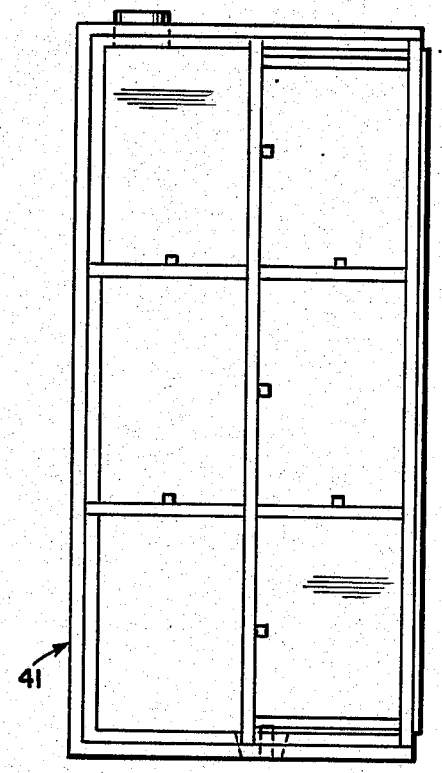
FIG. 10 is an elevational view of the other side wall of the chamber with the outer liner removed, opposite the wall shown in FIG. 8.
Figure 11:
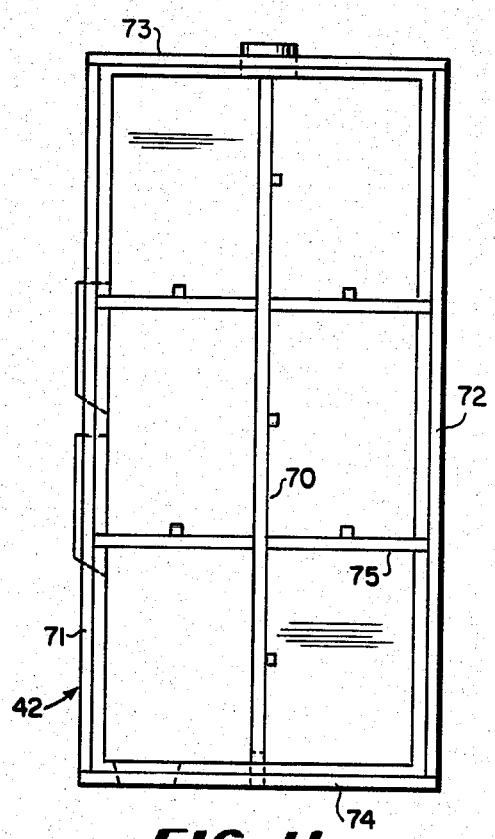
FIG. 11 is an elevational view of the rear wall of the chamber with the outer liner removed, taken from the inside thereof.

The construction of the skeletal framework of the sidewall 41 and backwall 42 are substantially similar and are shown respectively in FIGS. 10 and 11. In each of these structures an additional long upright beam 70 is provided intermediate the vertical beams 71 and 72 of the frame, the beam 70 being joined at its respective ends to the horizontal members of the frame 73 and 74.

Further reinforcement for rigidity of the skeleton is had by cross pieces, such as is shown at 75, at several levels intersecting beam 70 and extending at their ends to be fixedly joined to beams 71 and 72.

As shown in FIG. 6, the top of the rigid framework of the chamber proper is reinforced with angle bars 60 and 61. Opening 64 is designed to receive line 67 through which gases in chamber 10 are vented. The bottom of the rigid framework, as shown in FIG. 7, is reinforced with angle bars 62 in a similar manner.

Figure 9:
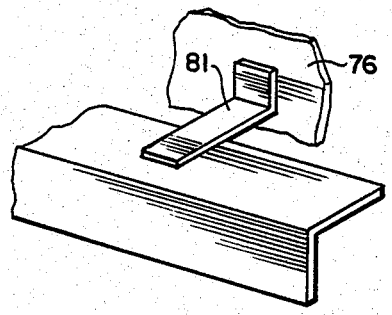
FIG. 9 is an enlarged fragmentary view showing details of the attachment of the inner panel of the door to the structural framework of the chamber.
Figure 12:
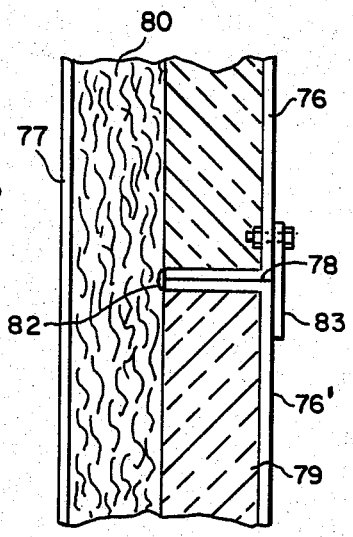
FIG. 12 is a fragmentary enlarged sectional view of a chamber wall, showing the insulation between the inner and outer liners.

The framework skeletons of the rear wall, each of the side walls, the top and the bottom are covered by a plurality of inner sheet metal liners 76 and an outer sheet metal liner 77; the inner liners and outer liner being spaced apart to provide a space for insertion of insulation material therebetween. As shown in FIG. 12 two such inner liners 76 and 76' are provided in abutting relation. The peripheral edges of the inner liners are bent outwardly at about 90° angles and are continuously welded at the outer ends 82, thereby forming an expansion joint 78 at the seam line between these liners. Rigid polyurethane foam insulation is installed adjacent the inner liners as indicated at 79, the remaining space to the outer liner 77 is filled by compression of fiber glass therein as indicated at 80. The size of the insulation space between the outer and inner liners is maintained by a pattern of retainers, as shown in FIG. 9. Clips 81 formed of sheet steel bent at right angles are provided with one arm welded to the structural angles of the wall frame at selected locations and the other arm welded to the adjacent inner liner. To prevent media particles or other debris from clogging the expansion joint 78, the joint is covered by a flat seal strip 83, one end of which is riveted or bolted to the liner adjacent the seam of joint 78 with the other end of the strip free to ride over the seam.

The outer liner panels are attached to the structural angles by spot welding. All joints in the inner and outer liners are continuously welded except for the corners of chamber 10. These corners are sealed with RTV silicone rubber contained by corner moldings (not shown). Preferably stainless steel is used for the inner and outer liners as well as the structural angles. Additional reinforcement is provided as required, at the inner and outer liners of the chamber and of the outer door, by attachment of steel plate thereto, particularly at locations where mechanical elements are affixed. Thus, in FIG. 8, for example, steel plate is attached to the outer wall spanning struts 57 and struts 54 for mounting of the throwing wheel housings, the plates having openings therein as well as in the outer and inner liners, as indicated at 85, 86, for admission of impact media into the chamber. Similar plate steel reinforcement is provided on the outer and inner panels of door 11 at locations where mechanical accessories are attached thereto.

The illustrated embodiment is designed for an insulated decoating chamber of about 9 feet (2.74 meters) in height and about 5×5 feet (1.52×1.52 meters) in cross section, wherein each of the three walls and the outer door have two inner panels. In a structure of larger dimensions, three or more of such abutting inner liners would be employed. The largest linear dimension, without an expansion joint, of any inner liner of the door and of any wall of the chamber should not exceed that undergoing a shrinkage of 0.22% of such longest dimension at room temperature when exposed to the lowest operating temperature.

Referring again to FIGS. 1 and 2, a cantilever beam 90 extends laterally from the inner face of door 11 near the top thereof, which beam will extend into chamber 10 when the door is in its closed position. Drive mechanism, comprising a motor 91 and speed reduction gearing 92, is mounted on the outer face of the door. The gearing is provided with a horizontal drive shaft 94 passing through a bore in beam 90 and operatively arranged by suitable mechanical means to rotate a work piece-supporting fixture 95, operated within the chamber when door 11 is closed. The particular construction of fixture 95 and the driving means therefor forms no part of the present invention but is the subject of copending application Ser. No. 461,087 filed Jan. 26, 1983.

Extending laterally from the inner face of panel 27, adjacent the bottom thereof is a support arm 96, provided with a slot 97 at its free end. Fixture 95 comprises a suitable shaft 98, the upper end of which is operatively connected for rotation by drive shaft 94 and the lower end of which is slidably supported within slot 97. Thus, any relative movement between panels 26 and 27 as a result of expansion or contraction, is readily accommodated without distortion of shaft 98.

Chamber 10 is also provided with an inner door 100, arranged to swing into closed position when door 11 is opened and to swing back into the chamber to a position adjacent the inner face of a side wall. Inner door 100 comprises a frame made from square aluminum tubing, with an aluminum sheet affixed to one side of the frame.

In its closed position (shown by the dotted outline in FIG. 1) the peripheral edge of door 100 fits tightly against the inner face of the opposed jamb and doorway frame of the chamber. Door 100 is fixedly hinged adjacent top and bottom thereof to a rotatable shaft 101, whereby rotation of the shaft through an arc of about 90° effects corresponding movement of door 100 between its open and closed positions. Rotation of shaft 101 is effected by means of an air cylinder 103 or other suitable operating mechanism, arranged to be actuated in cycle through relays or other interconnecting means communicating with drive means 14, such that door 100 swings to closed position when outer door 11 is opened and returns to open position when door 11 is closed.

Preferably, a guard plate 105 may be affixed to the front face of door 100 to protect the door surface from being bombarded by impact media during decoating or deflashing of articles within chamber 10.

As shown particularly in FIGS. 5 and 7, an opening is provided in the floor of chamber 10 into which opening a chute 106 is fitted and sealed at its outer walls. Chute 106 permits the coating material and spent media to be removed continuously from the chamber. This material empties into 107 for transportation to a separation device (not shown). A preferred arrangement for removing this material from the floor of chamber 10, is that more fully shown and described in copending application Ser. No. 445,603.

While not limited to any particular dimensions of the chamber and structural parts thereof, the invention provides a reliable solution of problems presented by thermal expansion and contraction in structures of a size wherein the extent of warping and buckling of walls or doors would otherwise be prohibitive. Thus, for example, by construction in accordance with the invention, cryogenic treating chambers of about nine feet in height (2.74 meters) can be reliably employed in batch operation for decoating of workpieces at temperatures in the order of −200° F., despite frequent opening and closing of the access door thereto. This is accomplished without resort to massive structural elements. The metallic framework used for both the chamber and the door, although relatively light, provide a structure of required rigidity substantially free of distortion and misalignment. Thermal insulating properties are maintained, although the inner linings will undergo their full thermal contraction, the shrinkage being accommodated by the flexibile expansion joints provided and by the flexible support members which attach the lining to the basic framework. The extent of expansion is limited by resort to the use of two separate and independent panels. The integrity of the insulation is maintained because of the provided protection against access of moisture. Such protection is afforded by the continuous welding of joints in the liners and use of silicone rubber seals at corners where welding is impractical.

What is claimed.

1. A thermally insulated chamber for batch treatment of materials therein at low temperature, said chamber having side walls, a rear wall and a front doorway and a thermally insulated outer access door arranged at said doorway; mechanical means for swinging said outer door between open to closed positions, wherein the side walls and back wall of said chamber each comprises:

(a) a rigid skeletal metallic framework, (b) a sheet metal liner attached to the outer face of said framework, and (c) a plurality of inner liners in abutted relation forming a seam line between their bordering outwardly bent and joined edges, thereby providing an expansion joint at said seam line;

said outer door comprising:

(d) a rigid door structural framework, (e) a metallic outer sheet metal liner attached to the outer face of said door framework, (f) and a plurality of rectangular pan-shaped inner sheet metal liners attached to the outer liner of said door inwardly of the periphery of said outer liner, thereby providing a peripheral band on the inner face of said outer liner, through which band the outer liner is attached to the framework of said outer door.

2. A chamber as defined in claim 1 wherein the framework of said outer door is made up of vertical channel-shaped metal beams joined at their tops and bottoms to horizontal beams to form a rectangular structure.

3. A chamber as defined in claim 1 wherein said chamber is further provided with an inner door arranged to swing within the chamber from its open position when said outer door is closed to its closed position against the inner face of said doorway frame when said outer door is open; and inter-connected operating means for co-ordinating the respective movements of said inner and outer door.

4. A chamber as defined in claim 3 wherein said inner door comprises a rigid rectangular frame and a plate attached to one side of said frame, said frame and plate comprising a material having substantially the same high thermal conductivity.

5. A chamber as defined in claim 4 wherein said frame and plate are comprised of aluminum.

6. A chamber as defined in claim 1 wherein each of said pan-shaped inner liners of the outerdoor comprises a flat sheet having turned up peripheral border edges, each of said edges being bent inwardly to provide a peripheral flange, through which flange said inner liner is attached to said outer liner; thereby providing a space between the opposed faces of said inner and outer liners for containing thermal insulation material.

7. A chamber as defined in claim 6 wherein said pan-shaped inner liners of said outer door are arranged to provide a boundary line between their opposed turned-up border edges; a cover plate overlying said boundary line, said cover plate being attached to the exposed face of one of said pan-shaped liners and being free to move over the exposed face of the other of said pan-shaped liners, thereby providing an expansion joint accommodating thermal expansion and contraction of said inner liners.

8. A chamber as defined in claim 1 wherein the skeletal framework of the side walls and the back wall of said chamber are formed of vertical and horizontal angle metal bars joined to one another at their extemities to form a rectangle, and additional horizontal reinforcing metal bars extending between and are affixed to the vertical metal bars at intermediate levels.

9. A chamber as defined in claim 8 wherein one of the side walls thereof is provided with at least one pair of vertical reinforcing struts spanning the space between a pair of said additional horizontal reinforcing bars, said pair of struts being spaced apart from one another to border an opening within the wall to accommodate the discharge outlet of a throwing wheel housing attached to the outer face of the said one of said walls.

10. A thermally insulated outer access door for a thermally insulated chamber for treatment of materials therein at low temperature, said door comprising a rectangular peripheral frame and an insulated multi-panel assembly attached to said frame; said assembly comprising an outer sheet metal liner to which are attached at least two separate inner sheet metal liners in adjoining relation one above the other; the opposed faces of the outer liner and the said inner liners being spaced from one another to provide an insulation space therebetween with insulation material filling said space; each of said inner liners being made of a flat sheet having an integral peripheral wall formed by bending the edges of said flat sheet away from the flat surface of the sheet, the free edge portions of said peripheral wall being further bent inwardly to form a peripheral flange by which each of said inner liners is attached to said outer sheet metal liner; and wherein each of said inner liners is attached to said outer liner inwardly of the edges of said outer liner, thereby leaving a peripheral border on the inner face of said outer liner, through which border said multi-panel assembly is affixed to the peripheral frame of said door.

11. A chamber as defined in claim 10 wherein adjacent the boundary of said adjoining separate inner liners a metal plate is fixedly attached to the upper one of said liners, with the free end of said plate extending over a portion of the surface of the lower one of said liners, thereby covering the boundary line therebetween; and thus providing an expansion joint protected against entry of matter into said joint.

* * * * *